US010704758B2

(12) United States Patent
Gu

(10) Patent No.: US 10,704,758 B2
(45) Date of Patent: Jul. 7, 2020

(54) LIGHT SHIELD

(71) Applicant: CARICAN—UOG OPTICS SUZHOU CO., LTD., Suzhou (CN)

(72) Inventor: Wei Gu, Suzhou (CN)

(73) Assignee: UOG OPTICS SUZHOU CO., LTD. (CN)

( * ) Notice: Subject to any disclaimer, the term of this patent is extended or adjusted under 35 U.S.C. 154(b) by 0 days.

(21) Appl. No.: 16/429,293

(22) Filed: Jun. 3, 2019

(65) Prior Publication Data

US 2020/0088376 A1 Mar. 19, 2020

(51) Int. Cl.
*F21S 41/40* (2018.01)

(52) U.S. Cl.
CPC ..... *F21S 41/40* (2018.01)

(58) Field of Classification Search
CPC ..... F21S 41/40
See application file for complete search history.

(56) References Cited

U.S. PATENT DOCUMENTS 6,186,651 B1 * 2/2001 Sayers ..... F21S 41/17 362/512
2006/0039158 A1 * 2/2006 Kurz ..... B60Q 1/085 362/539
2009/0059612 A1 * 3/2009 Yang ..... F21S 41/47 362/513
2012/0113662 A1 * 5/2012 Shibata ..... F21S 41/686 362/512

FOREIGN PATENT DOCUMENTS

CN 207407291 U 5/2018

* cited by examiner

*Primary Examiner* — Thomas M Sember

(57) ABSTRACT

A light shield comprising a clamping mechanism, a shield and a motor, wherein a light-outlet groove is formed in the clamping mechanism, the shield is arranged on the clamping mechanism in a reciprocating mode through a limiting mechanism, and the motor is used for driving the shield to move back and forth along the clamping mechanism, thereby enabling the shield to conveniently block or unblock the light-outlet groove; according to the present invention, the variation of the light amount and the light pattern of the automobile headlamp can be achieved through blocking or unblocking the light-outlet groove by the shield, and through changing the reflected light pass region of the reflector.

10 Claims, 3 Drawing Sheets

LIGHT SHIELD

TECHNICAL FIELD OF THE INVENTION

The present invention relates to the technical field of automobile high-low beam light switching, and more particularly, to a light shield.

BACKGROUND OF THE INVENTION

A light shield is a working structure enabling automobile headlamps to achieve an integration of high-low beams. Through switching the light shield, the conversion of high-low beams can be achieved. When the light shield is in a natural state, a low-beam pattern is presented, and when the motor is initiated to switch the light shield, a high-beam pattern is presented. In the prior art, the light shield of the dual-light reflector of the left support and that of the right support cannot be shared. The left support dual-light reflector corresponds to the left support light shield and the left support motor, and the right support dual-light reflector corresponds to the right support light shield and the right support motor.

The Chinese patent (publication no.: CN207407291U) discloses a novel light-shielding structure used for a dual-light reflector, which comprises a clamp holder, a shield movably arranged on the clamp holder, and a motor for driving the shield to move. The moving track of the shield coincides with the telescopic track of the main shaft of the motor. The clamp holder at least comprises a holder body, and a pair of limiting movable blocks that are symmetrically arranged on the holder body. The shield is clamped between the pair of limiting movable blocks, and when being driven by the motor, moves up and down along its vertical axis direction. However, although the aforesaid technical solution solves the problem that the light shield of the dual-light reflector of the left support and that of the right support cannot be shared, the shield is fixed by utilizing the limiting movable blocks that are clamped at the two sides of the shield, resulting in the structural abrasion of the edge of the limiting movable blocks or the light shield, or the failure of control of the light shield due to reasons such as an imprecise placement of the movable blocks. Under such circumstances, the switching of the high-low beams cannot be achieved.

SUMMARY OF THE INVENTION

The purpose of the present invention is to solve the shortcomings in the prior art by providing a light shield. According to the present invention, a precise control of the movement direction of the shield can be realized, an effective control of the high-low beam lights can be further achieved, and the driving safety can be greatly enhanced.

To achieve the above purpose, the present invention adopts the following technical solution:

A light shield comprising a clamping mechanism, a shield and a motor, wherein a light-outlet groove is formed in the clamping mechanism, the shield is arranged on the clamping mechanism in a reciprocating mode through a limiting mechanism, and the motor is used for driving the shield to move back and forth along the clamping mechanism, thereby enabling the shield to conveniently block or unblock the light-outlet groove.

In another aspect of the present invention, the limiting mechanism comprises a limiting column fixed on the clamping mechanism, and a long strip-shaped limiting hole formed in the shield. The limiting column penetrates through the long strip-shaped limiting hole in a matched mode. The length direction of the long strip-shaped limiting hole is the back-and-forth movement direction of the shield.

In another aspect of the present invention, the two ends of the long strip-shaped limiting hole are provided with semi-circular structures that are matched with the limiting column, and the diameter of the end cap of the limiting column is greater than the width of the long strip-shaped limiting hole.

In another aspect of the present invention, the number of the long strip-shaped limiting holes is two, and the two long strip-shaped limiting holes are respectively formed in the two ends of the shield. The number of the limiting columns corresponds to the number of the long strip-shaped limiting holes.

In another aspect of the present invention, the light-outlet groove is formed in the upper edge of the clamping mechanism. The bottom of the light-outlet groove is consisted of a second gradient surface and an arc surface that are connected in sequence. The two sides of the upper end of the clamping mechanism are respectively provided with a third horizontal end surface and a fourth horizontal end surface. The third horizontal end surface is parallel to the fourth horizontal end surface. The third horizontal end surface is connected with the second gradient surface, and the arc surface is connected with the fourth horizontal end surface. The intersection line of the second gradient surface and the third horizontal end surface and the center line of the length direction of the long strip-shaped limiting hole are located in the same plane. The included angle between the second gradient surface and the horizontal plane is 45 degrees. The included angle between the horizontal plane and the tangent line of the arc surface on the intersection line of the arc surface and the fourth horizontal end surface is 15 degrees.

In another aspect of the present invention, the upper edge of the shield comprises a first horizontal end surface, a first gradient surface and a second horizontal end surface. The first horizontal end surface and the second horizontal end surface are parallel to the third horizontal end surface. The included angle between the first gradient surface and the horizontal surface is 15 degrees. When the shield blocks the light-outlet groove, the first horizontal end surface is overlapped with the third horizontal end surface, and the second horizontal end surface is overlapped with the fourth horizontal end surface. When the shield unblocks the light-outlet groove, the first horizontal end surface is lower than or flush with the lowest point of the arc surface.

In another aspect of the present invention, the center line of the light-outlet groove and the center line of the shield are located in the same plane in parallel, and the plane is perpendicular to the shield.

In another aspect of the present invention, the motor is fixedly arranged on the clamping mechanism.

In another aspect of the present invention, the motor is a linear motor, and the output shaft of the linear motor is connected with the shield.

In another aspect of the present invention, the shield comprises a first plate and a second plate. The second plate is vertically connected at the bottom end of the first plate, and the output shaft of the linear motor is connected with the second plate.

In another aspect of the present invention, the light shield further comprises a spring sleeved on the output shaft, wherein one end of the spring abuts against the shield, and the other end of the spring abuts against the shell of the motor.

Compared with the prior art, the present invention has the following advantages:

The light shield of the present invention comprises a clamping mechanism, a shield and a motor, wherein a light-outlet groove is formed in the clamping mechanism, the shield is arranged on the clamping mechanism in a reciprocating mode through a limiting mechanism, and the motor is used for driving the shield to move back and forth along the clamping mechanism, thereby enabling the shield to conveniently block or unblock the light-outlet groove. According to the light shield of the present invention, the variation of the light amount of the automobile headlamp can be achieved through blocking or unblocking the light-outlet groove 20 by the shield 1, and through changing the reflected light pass region of the reflector. Thus, a free switching between the high beam light state and the low beam light state of the automobile headlamp can be realized.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1. Shield, 11. The First Plate, 12. The Second Plate, 13. Long Strip-shaped Limiting Hole, 14. The First Horizontal End Surface, 15. The Frist Gradient Surface, 16. The Second Gradient Surface, 2. Clamping Mechanism, 20. Light-outlet Groove, 21. Limiting Column, 22. The Third Horizontal End Surface, 23. The Second Gradient Surface, 24. Arc Surface, 25. The Fourth Horizontal End Surface, 3. Motor, 31. Output Shaft, 32. Coil, 34. Shell, 4. Spring.

DETAILED DESCRIPTION OF THE INVENTION

For making the objectives, technical solutions and advantages of the present invention clearer, drawings and detailed embodiments are combined hereinafter to elaborate the technical solutions of the present invention.

Embodiment 1

Figure 1:
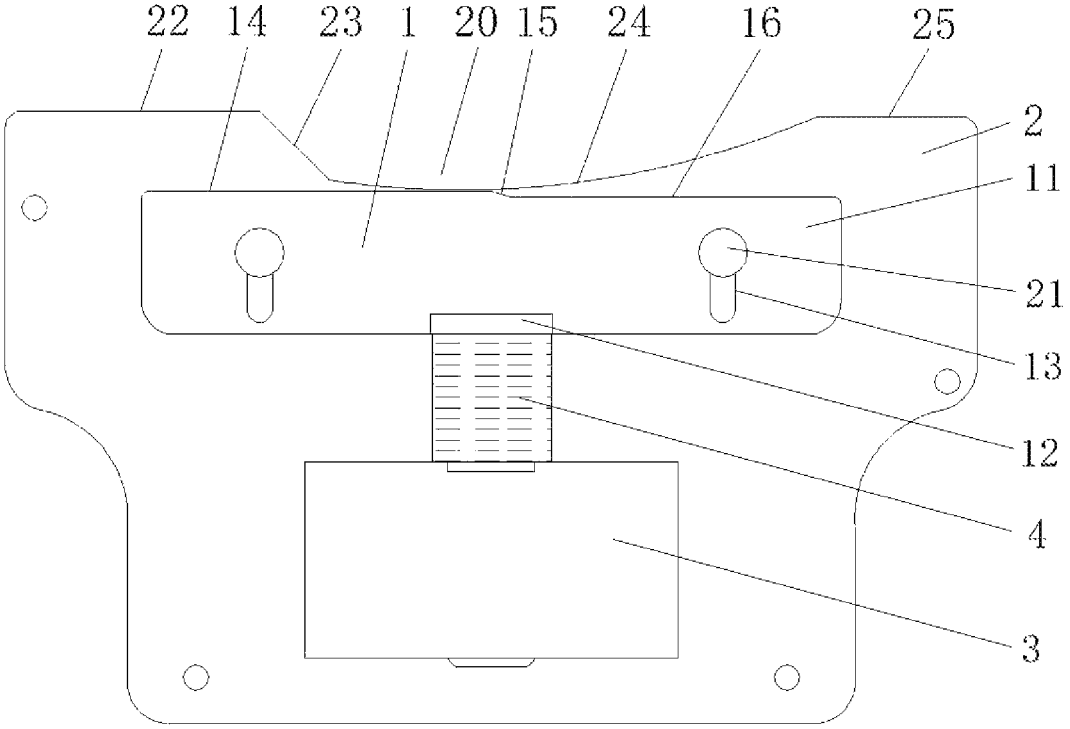
FIG. 1 is a structural diagram illustrating the first working state of the present invention.
Figure 2:
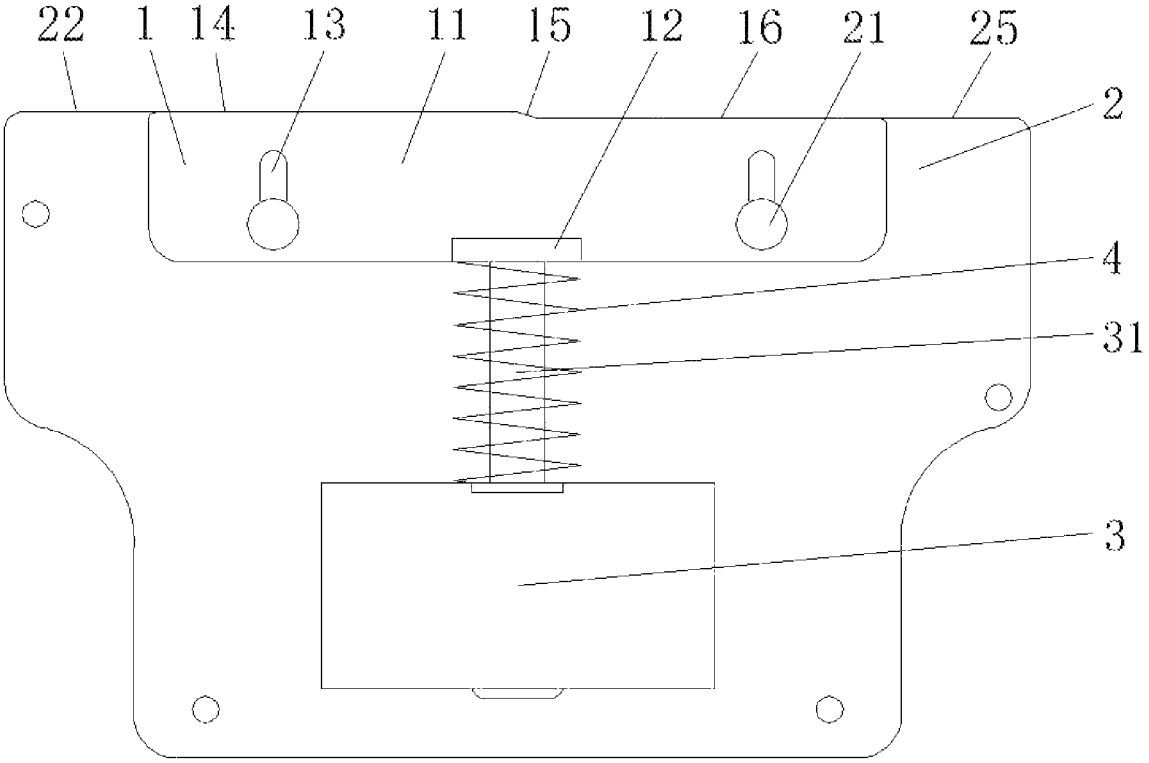
FIG. 2 is a structural diagram illustrating the second working state of the present invention.
Figure 3:
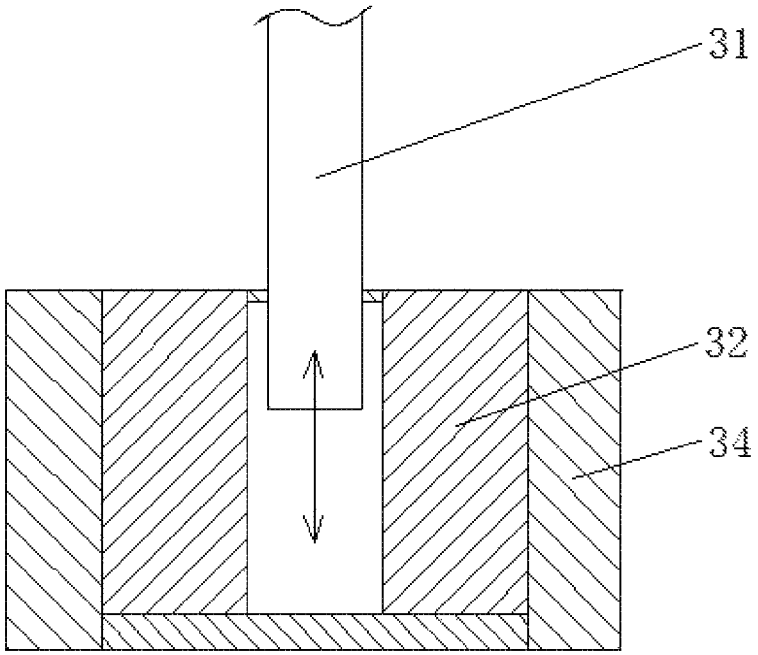
FIG. 3 is a sectional view of the linear motor of the present invention.

As shown in FIGS. 1-3, the light shield of the present invention comprises a clamping mechanism 2, a shield 1 and a motor 3, wherein a light-outlet groove 20 is formed in the clamping mechanism 2, the shield 1 is arranged on the clamping mechanism 2 in a reciprocating mode through a limiting mechanism, and the motor 3 is used for driving the shield 1 to move back and forth along the clamping mechanism 2, thereby enabling the shield 1 to conveniently block or unblock the light-outlet groove 20.

An automobile headlamp generally comprises a reflector, a light source, a support, a lens and a light shield arranged between the reflector and the support. The light source is arranged in the reflector. The light emitted by the light source, and the light reflected by the reflector and then emitted out of the reflector, are emitted through the lens after the light pattern is adjusted by the light shield. Normally, the light pattern of an automobile headlamp integrating high-low beam lights comprises a high beam light pattern and a low beam light pattern. In short, after being adjusted by the light shield, the light pattern can be a high beam light pattern or a low beam light pattern. Namely, the light pass region formed by the light shield and the reflector can be a low beam light pass region or a high beam light pass region. When the light shield of the present invention is applied to a prior automobile headlamp, and when the light shield 1 completely blocks the light-outlet groove 20, the light pass region formed by the reflector and the light shield of the present invention is a low beam light pass region. Namely, after being adjusted by the light shield of the present invention, the pattern of the light emitted by the light source and reflected by the reflector is a low beam light pattern. When the shield 1 no longer blocks the light-outlet groove 20, the light pass region formed by the reflector and the light shield of the present invention comprises a low beam light pass region and a light pass region formed by the light-outlet groove 20. Such a light pass region is a high beam light pass region. Namely, after being adjusted by the light shield of the present invention, the high beam light pass region comprises a low beam light pass region and a light pass region formed by the light-outlet groove 20, meaning that the pattern of the light emitted by the light source and reflected by the reflector is a high beam light pattern.

More specifically, as shown in FIG. 1, the shield 1 of the present invention is located underneath the light-outlet groove 20, namely, the light-outlet groove 20 no longer being blocked. Namely, the light emitted by the light source and the light reflected by the reflector pass through the high beam light pass region, and are emitted through the lens. At this point, the automobile headlamp possesses a high amount of light. Namely, when the light shield of the present invention is in the aforesaid state, the automobile headlamp is in a high beam light mode. When there's a need to switch to the low beam light, the motor 3 is initiated, thereby driving the shield 1 to move upwards until the light-outlet groove 20 is completely blocked by the shield 1, namely, the shield 1 blocking the light-outlet groove 20. At this point, the light emitted by the light source and the light reflected by the reflector pass through the low beam light pass region, and are finally emitted through the lens. At the moment, the shield 1 blocks the light-outlet groove 20 so that the light amount of the automobile headlamp is comparatively low. Namely, when the light shield of the present invention is in such a state, the automobile headlamp is in a low beam light mode. When there's a need to switch to the high beam light again, the motor 3 is reversely initiated, thereby driving the shield 1 to move downwards. It shows that the light shield of the present invention can achieve the variation of the light amount of the automobile headlamp through blocking or unblocking the light-outlet groove 20 by the shield 1, and through changing the light pass region (namely, switching between the high beam light pass region and the low beam light pass region) of the reflector. Thus, a free switching between the high beam light state and the low beam light state of the automobile headlamp can be realized.

More specifically, the limiting mechanism comprises a limiting column 21 fixed on the clamping mechanism 2, and a long strip-shaped limiting hole 13 formed in the shield 1. The length direction of the long strip-shaped limiting hole 13 is the back-and-forth movement direction of the shield 1.

The limiting column 21 penetrates through the long strip-shaped limiting hole 13 in a matched mode. When the motor 3 drives the shield 1 to move back and forth, the long strip-shaped limiting hole 13 moves back and forth along the limiting column 21. The limiting mechanism of the present invention is simple, cost-effective and can be conveniently assembled. The two ends of the long strip-shaped limiting hole 13 are provided with semicircular structures that are matched with the limiting column 21, which realize the effective fitness with the limiting column 21, and achieve the effective control of the relative moving range of the long strip-shaped limiting hole 13 and the limiting column 21, thereby effectively controlling the moving range of the shield 1. The diameter of the end cap of the limiting column 21 is greater than the width of the long strip-shaped limiting hole 13. According to this design, the shield 1 can be effectively prevented from being separated from the limiting column 21 to move, enabling the limiting column 21 to effectively control the shield 1. The number of the long strip-shaped limiting holes 13 is two, and the two long strip-shaped limiting holes 13 are respectively formed in the two ends of the shield 1. The number of the limiting columns 21 corresponds to the number of the long strip-shaped limiting holes 13. In the present invention, there're two long strip-shaped limiting holes 13, which realize the structural balance, make the back-and-forth movement of the shield 1 more stable, and achieves a higher overall structural strength.

Specifically, the shield 1 is an integrated structure comprising a first plate 11 and a second plate 12 that is perpendicular to the first plate 11 and is located in the middle of the lower edge of the first plate 11. It should be noted that the long strip-shaped limiting hole 13 is formed in the first plate 11. Additionally, the motor 3 in embodiment 1 is a linear motor, and the output shaft 31 of the linear motor is fixedly connected with the second plate 12 of the shield 1.

As shown in FIG. 3, the linear motor comprises a coil 32 and an output shaft 31 movably arranged in the coil 32. The coil 32 of the linear motor 3 is electrified, and the electrifying direction is continuously changed, thereby forming a magnetic field in the coil 32 so that the output shaft 31 can be driven to move up and down. Specifically, the axis line of the output shaft 31 is perpendicular to the second plate 12, and coincides with the center line of the first plate 11. According to this arrangement, the motor 3 can evenly impose a force onto the shield 1, and the axial line of the shield 1 can be effectively controlled to move back and forth along the direction of the axis line of the output shaft, which prevents the shield 1 from easily swinging left and right. Namely, the movement of the shield 1 along the direction of the long strip-shaped limiting hole 13 can be effectively controlled, and after the long strip-shaped limiting hole 13 is worn, the movement of the shield 1 along the axis line of the output shaft can still be ensured. Thus, the deviation of the shield 1 can be avoided so that a high reliability of the shield 1 can be achieved. The shield 1 is fixedly connected to the output shaft 31 through the second plate 12, achieving a convenient connection and a low manufacturing cost.

Specifically, the light-outlet groove 20 is formed in the upper edge of the clamping mechanism 2. The bottom of the light-outlet groove 20 is consisted of a second gradient surface 23 and an arc surface 24 that are connected in sequence. The two sides of the upper end of the clamping mechanism 2 are respectively provided with a third horizontal end surface 22 and a fourth horizontal end surface 25. The third horizontal end surface 22 is parallel to the fourth horizontal end surface 25. The third horizontal end surface 22 is connected with the second gradient surface 23, and the arc surface 24 is connected with the fourth horizontal end surface 25. The intersection line of the second gradient surface 23 and the third horizontal end surface 23 and the center line of the length direction of the long strip-shaped limiting hole 13 are located in the same plane. The included angle between the second gradient surface 23 and the horizontal plane is 45 degrees. The included angle between the horizontal plane and the tangent line of the arc surface 24 on the intersection line of the arc surface 24 and the fourth horizontal end surface 25 is 15 degrees. By means of this structural design, an accurate control of the high beam light can be further achieved, and an ideal light pattern of the high beam light can be ensured, achieving better optical performance of the high beam light, and significantly improving the driving safety.

Specifically, the upper edge of the shield 1 comprises a first horizontal end surface 14, a first gradient surface 15 and a second horizontal end surface 16. The first horizontal end surface 14 and the second horizontal end surface 16 are parallel to the third horizontal end surface 22. The included angle between the first gradient surface 14 and the horizontal surface is 15 degrees. When the shield 1 blocks the light-outlet groove 20, the first horizontal end surface 14 is overlapped with the third horizontal end surface 22, and the second horizontal end surface 16 is overlapped with the fourth horizontal end surface 25. When the shield 1 unblocks the light-outlet groove 20, the first horizontal end surface 14 is lower than or flush with the lowest point of the arc surface 24. The aforesaid structural design realizes the precise control of the low beam light pattern, making the optical performance of the low beam light better, enhancing the driving safety, protecting drivers in the opposite direction from being dazzled, and avoiding hidden safety hazards.

Further, the center line of the light-outlet groove 20 and the center line of the shield 1 are located in the same plane in parallel, and the plane is perpendicular to the shield 1. Meanwhile, the clamping mechanism and the first plate of the shield are both flat-plate structures. In this way, the position of the shield 1 can be ensured to correspond to the position of the light-outlet groove 20. Namely, when the shield 1 moves relative to the light-outlet groove 20, the vertical distance between the shield 1 and the light-outlet groove 20 does not change. When the shield 1 blocks the light-outlet groove 20, a light gap can no longer be generated. Thus, the light-emitting effect can be ensured, achieving an ideal switching effect of the high beam light state and the low beam light state of the automobile headlamp.

Specifically, the linear motor 3 in embodiment 1 is fixedly connected on the clamping mechanism 2 through screws, achieving a simple and convenient installation.

Embodiment 2

The difference between embodiment 2 and embodiment 1 only lies in: the shield 1 of the present invention further comprises a spring 4 sleeved on the output shaft 31, wherein one end of the spring 4 abuts against the shield 1, and the other end of the spring 4 abuts against the shell 34 of the motor 3.

As described in embodiment 1, as shown in FIG. 3, the linear motor comprises a coil 32 and an output shaft 31 that is movably arranged in the coil 32. When the coil 32 of the linear motor 3 is electrified, a magnetic field is formed in the coil 32, thereby driving the output shaft 31 to move.

Specifically, in this embodiment, the spring 4 is provided with a plurality of working states:

1. If the spring 4 in FIG. 1 is in a natural state (i.e. the spring is not stretched or compressed), at this point, the coil 32 is electrified in the forward direction, and an acting force is generated between the coil 32 and the output shaft 31, thereby driving the output shaft 31 to extend out so that the shield 1 is pushed to block the light-outlet groove 20 (as shown in FIG. 2). At this point, the spring 4 is in a stretched state. When there's a need to switch to the high beam light, the coil 32 is powered off, the output shaft 31 retracts to reset under the action of the pulling force of the spring 4, and the shield 1 unblocks the light-outlet groove 20.
2. When the coil 32 is electrified in the reverse direction, the spring 4 is kept in a compressed state through the acting force generated between the coil 32 and the output shaft 31. As shown in FIG. 1, when there's a need to switch to the low beam light, the coil 32 is powered off, the output shaft 31 is driven to extend out under the acting force of the stretched spring, and the shield 1 is pushed to block the light-outlet groove 20 (as shown in FIG. 2).

As can be seen from the aforesaid description, through the arrangement of the spring 4 of the present invention, half of the energy consumption can be reduced, achieving an excellent technical effect.

What stated above are merely preferred embodiments of the present invention but are not used to limit the present invention. Any modification, equivalent replacement, improvement, etc. within the spirit and principle of the present invention shall be regarded as within the protection scope of the invention.

The invention claimed is:

1. A light shield, comprising:

a clamping mechanism, a shield, and a motor, wherein a light-outlet groove is formed in the clamping mechanism, the shield is arranged on the clamping mechanism in a reciprocating mode through a limiting mechanism, and the motor is used for driving the shield to move back and forth along the clamping mechanism, thereby enabling the shield to conveniently block or unblock the light-outlet groove, wherein the limiting mechanism comprises a limiting column fixed on the clamping mechanism, and a long strip-shaped limiting hole formed in the shield, wherein the limiting column penetrates through the long strip-shaped limiting hole in a matched mode, wherein the length direction of the long strip-shaped limiting hole is the back-and-forth movement direction of the shield.

2. The light shield of claim 1, wherein the two ends of the long strip-shaped limiting hole are provided with semicircular structures that are matched with the limiting column, and the diameter of the end cap of the limiting column is greater than the width of the long strip-shaped limiting hole.

3. The light shield of claim 1, wherein the number of the long strip-shaped limiting holes is two, and the two long strip-shaped limiting holes are respectively formed in the two ends of the shield, wherein the number of the limiting columns corresponds to the number of the long strip-shaped limiting holes.

4. The light shield of claim 1, wherein the light-outlet groove is formed in the upper edge of the clamping mechanism, the bottom of the light-outlet groove is consisted of a second gradient surface and an arc surface that are connected in sequence, wherein the two sides of the upper end of the clamping mechanism are respectively provided with a third horizontal end surface and a fourth horizontal end surface, wherein the third horizontal end surface is parallel to the fourth horizontal end surface, wherein the third horizontal end surface is connected with the second gradient surface, and the arc surface is connected with the fourth horizontal end surface, wherein the intersection line of the second gradient surface and the third horizontal end surface and the center line of the length direction of the long strip-shaped limiting hole are located in the same plane, wherein the included angle between the second gradient surface and the horizontal plane is 45 degrees, wherein the included angle between the horizontal plane and the tangent line of the arc surface on the intersection line of the arc surface and the fourth horizontal end surface is 15 degrees.

5. The light shield of claim 4, wherein the upper edge of the shield comprises a first horizontal end surface, a first gradient surface and a second horizontal end surface, wherein the first horizontal end surface and the second horizontal end surface are parallel to the third horizontal end surface, wherein the included angle between the first gradient surface and the horizontal surface is 15 degrees, wherein when the shield blocks the light-outlet groove, the first horizontal end surface is overlapped with the third horizontal end surface, and the second horizontal end surface is overlapped with the fourth horizontal end surface, wherein when the shield unblocks the light-outlet groove, the first horizontal end surface is lower than or flush with the lowest point of the arc surface.

6. The light shield of claim 5, wherein the center line of the light-outlet groove and the center line of the shield are located in the same plane in parallel, and the plane is perpendicular to the shield.

7. The light shield of claim 1, wherein the motor is fixedly arranged on the clamping mechanism.

8. The light shield of claim 1, wherein the motor is a linear motor, and the output shaft of the linear motor is connected with the shield.

9. The light shield of claim 8, wherein the shield comprises a first plate and a second plate, wherein the second plate is vertically connected at the bottom end of the first plate, and the output shaft of the linear motor is connected with the second plate.

10. The light shield of claim 9, wherein the light shield further comprises a spring sleeved on the output shaft, wherein one end of the spring abuts against the shield, and the other end of the spring abuts against the shell of the motor.

* * * * *